United States Patent [19]

Müller

[11] 4,003,207

[45] Jan. 18, 1977

[54] METHOD OF AND DEVICE FOR ANCHORING A REINFORCEMENT BEAM TO A SHEET PILING

[76] Inventor: Ludwig Müller, Heinrich-Heine-Strasse, 44-46, 355 Marburg an der Lahn, Germany

[22] Filed: Oct. 28, 1975

[21] Appl. No.: 626,113

[30] Foreign Application Priority Data

Dec. 19, 1974 Germany ..... 7442205[U]

[52] U.S. Cl. ..... 61/39; 52/726; 61/49; 61/58; 403/354

[51] Int. Cl.[2] ..... E02D 5/74

[58] Field of Search ..... 61/49, 39, 58; 52/726; 403/354, 292, 364

[56] References Cited

UNITED STATES PATENTS

| | | | |
|---|---|---|---|
| 775,770 | 11/1904 | Herrod, Jr. | 403/354 |
| 2,708,828 | 5/1955 | Pruyn | 52/726 |
| 3,123,978 | 3/1964 | Pruyn | 61/58 |
| 3,490,242 | 1/1970 | Schnabel, Jr. | 61/49 |
| 3,628,300 | 12/1971 | Tsurumi | 52/726 |

*Primary Examiner*—Robert L. Wolfe
*Assistant Examiner*—Alexander Grosz
*Attorney, Agent, or Firm*—Hane, Sullivan & Spiecens

[57] ABSTRACT

There is disclosed a method of and a device for strengthening a sheet piling by means of one or more beams, particularly double T- or I-beams. Such strengthening is effected by driving a beam adjacent to one side of the sheet piling into the ground. The beam is secured to the sheet piling by an elongate strap. This strap has at one end an elongate slot and rigid bars are welded to the strap along the slotted end thereof either on one side or on both sides of the strap, depending upon whether the beam is a T-beam or a double T-beam. The strap so prepared is then slid at its slotted end into the web of the beam after it is driven into the ground and the bars are then welded to the cross bar or bars of the beam. The other end of the strap is suitably fastened to the sheet piling.

5 Claims, 3 Drawing Figures

METHOD OF AND DEVICE FOR ANCHORING A REINFORCEMENT BEAM TO A SHEET PILING

The present invention relates to a method of and a device for securing a beam partly driven into the ground adjacent to one side of a sheet piling and the protruding end of the beam is then fixedly secured to the sheet piling.

BACKGROUND

It is known to strengthen sheet pilings by means of one or more beams partly driven into the ground adjacent to the sheet piling on the side thereof opposite to the one which is exposed to water or other pressure. The protruding top end of the beam which is usually driven at a slant relative to the sheet piling is then suitably anchored to the sheet piling, usually at the top thereof. T-beams may be used for the purpose, but double T- or I-beams are generally preferable.

Anchoring of the beam to the sheet piling is generally effected by securing one end of a strap such as an elongate steel plate to the sheet piling and the other end of the strap to the beam.

A sufficiently strong attachment of the respective strap end to the beam in the manner as heretofore known and used presents several disadvantages. Driving of the beam into the ground must be effected before one strap end is secured thereto as unavoidably the structural components used for attaching the strap to the beam protrude above the head of the beam and obviously such protruding fastening means would be damaged or even destroyed by the heavy blows required for driving a beam into the ground. Accordingly, it is now standard practice to drive the beam into the ground before attaching the respective strap end to the beam. This eliminates damage to the fastening means, but does require extensive welding operations in situ. Such welding operations are bound to involve overhead welding and such overhead welding is difficult to perform and requires considerable skill on the part of the personnel carrying out the welding operations. The result is that the welding of the strap end to the head of the beam is often not sufficiently strong, and in any event costly.

THE INVENTION

It is a broad object of the invention to provide a novel and improved method of effecting most of the welding operations prior to attachment of the respective end of the strap to the head portion of the beam, thus limiting the welding operations which must be carried overhead and in situ for securing the strap to the beam to a minimum, and thus to welding steps which can be very easily carried out in situ.

It is also a broad object of the invention to provide a novel and improved device for securing the respective strap end to the head portion of the beam after the same has been driven into the ground by shaping the respective strap ends so that it can be slid upon the web of the beam and has already attached to it flat bars which can be easily welded to the cross bars of the beam after the strap has been slid upon the web of the beam. As a result, the only operation which must be carried out in situ is welding the bars on the strap to the cross bars of the beam, thereby greatly facilitating the attachment of the strap to the beam.

A more specific object of the invention is to provide a novel and improved device comprising an elongate strap which has a lengthwise slot at one end of a width such that the slot can be slid upon the web of the beam and by welding or otherwise securing the bars to the strap lengthwise of the slot, either on both sides of the strap if the beam is a double T-beam or only on one side if the beam is a T-beam. Attachment can then be completed by simply welding the readily accessible outer sides of the bars on the strap to the cross bars of the beam and finally securing the other end of the strap to the sheet piling.

BRIEF DESCRIPTION OF THE DRAWING

In the accompanying drawing a preferred embodiment is shown by way of illustration and not by way of limitation.

In the drawing.

DETAILED DESCRIPTION OF THE DRAWING

Referring now to the figures more in detail, there is shown a sheet piling 1 of conventional design. It is assumed that the main pressure acting upon the sheet piling is from the left side thereof. Accordingly, the reinforcing means for the sheet piling is on the right side thereof. The reinforcement means comprise a beam 15 driven into the ground preferably at a slant relative to the sheet piling. The beam is shown as a double T- or I-beam, but the concept of the invention can also be applied to a T-beam. The beam is secured at its head portion to the sheet piling by an anchoring or fastening device generally designated by 3. This device is secured to the head portion of the beam after the same has been driven into the ground.

Figure 2:
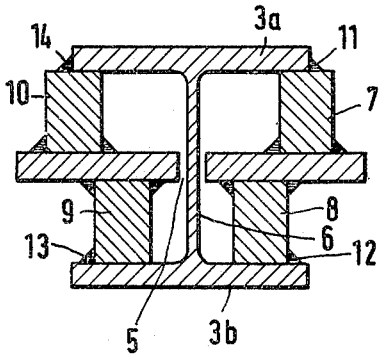
FIG. 2 is a sectional view taken on line II—II of FIG. 1 on an enlarged scale.
Figure 3:
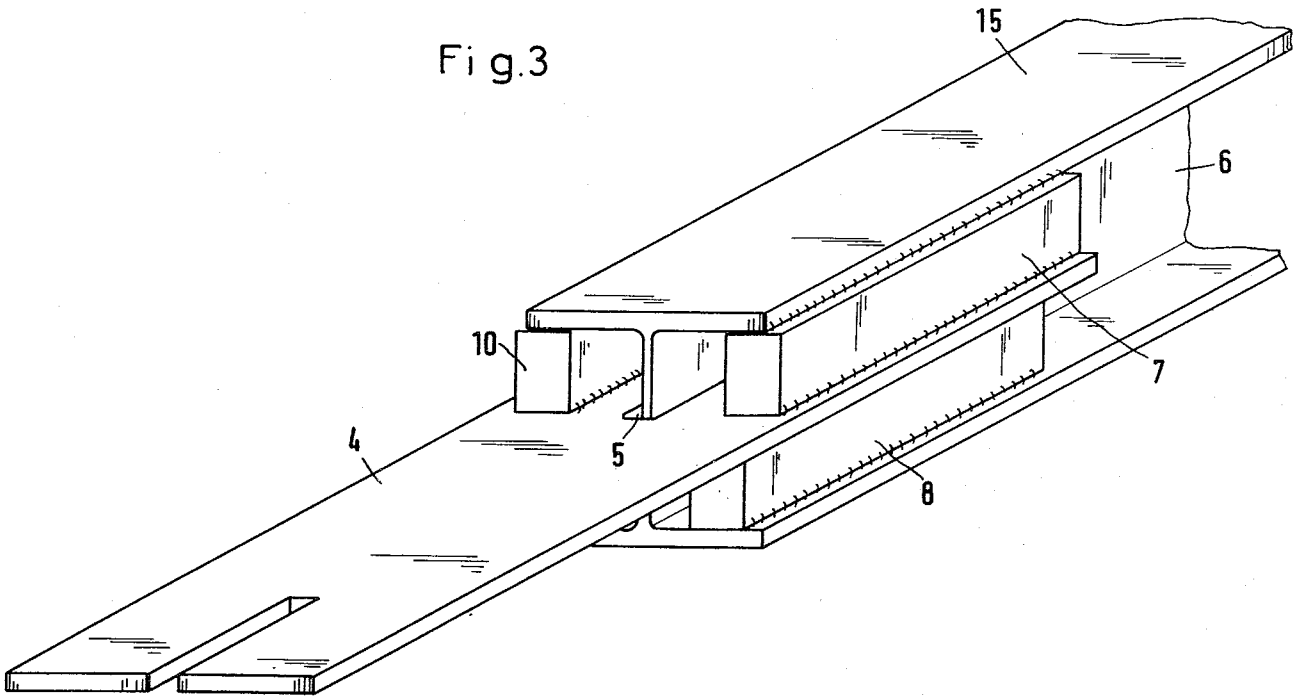
FIG. 3 is a perspective view of the device according to the invention shown secured to one end of the strap to the head portion of a double T- or I-beam.

As shown in detail in FIGS. 2 and 3, the fastening device comprises an elongate strap 4 which may be made of hard steel or other suitable material. This strap includes at its end to be secured to the beam a lengthwise elongate slot 5 which has a width such that it can be slid upon web 6 of the beam as it is shown in FIGS. 2 and 3.

Prior to the installation of the fastening device 3 on the head portion of the beam, four bars 7, 8, 9 and 10 made of a suitable hard material such as iron or steel, are secured to strap 4 alongside and preferably substantially parallel to slot 5. The bars are paired and each pair of bars is fixedly secured to the respective side of the strap, preferably by welding as it is indicated in FIGS. 2 and 3. The bars are shown to be staggered relative to each other as is shown in the figures, but they can also be placed in superimposition. The welding of the bars to the strap can and usually is effected in the plant.

After preparation of the strap as described, the strap is ready for attachment to the beam and more specifically to the head portion thereof. Such attachment is effected by sliding the strap with the bars welded thereon upon the web 6. FIG. 3 clearly shows the strap in that position. Anchoring of the device is then completed by welding each of the bars to the respective cross bars 3*a* and 3*b* of the beam. As the surfaces to be welded together are readily accessible, welding seams, 11, 12, 13 and 14 can be easily and strongly effected.

Figure 1:
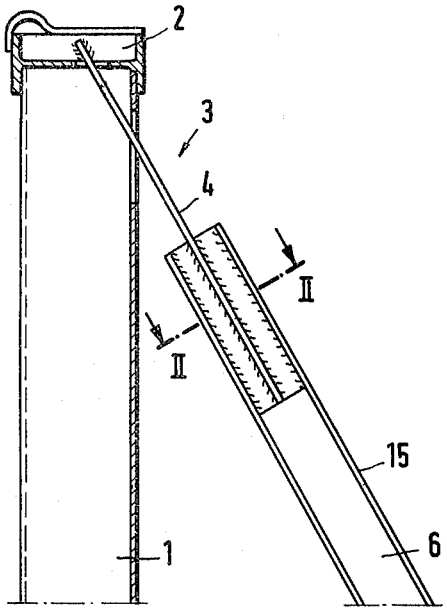
FIG. 1 is an elevational diagrammatic view of a sheet piling with a double T-beam secured thereto in accordance with the invention.

The other end of strap 4 which also may be slotted, is secured to the top portion of the sheet piling in a conventional and well known manner. FIG. 1 shows such mounting of the respective strap end at 2.

In the event the beam is a T-beam, two of the bars may be omitted, such as bars 7 and 10. The remaining bars 8 and 9 are then welded to cross bar 3*b*. In some instances it may be sufficient to use only two bars even though the beam is a double T-beam. As previously pointed out, the primary concept of the invention resides in providing an arrangement permitting to effect the difficult welding operations which heretofore had to be carried out by overhead welding in the plant where it presents no problems, rather than in situ.

While the invention has been described in detail with respect to a certain now preferred example and embodiment of the invention, it will be understood by those skilled in the art, after understanding the invention, that various changes and modifications may be made without departing from the spirit and scope of the invention, and it is intended, therefore, to cover all such changes and modifications in the appended claims.

What is claimed is:

1. A method of securing a driven-into the ground reinforcement beam to a sheet piling, said method comprising the steps of:

first providing a T-beam, an elongate strap having a lengthwise slot extending from one end of the strap and fitting the width of the web of the T-beam, and a pair of rigid bars welded to said strap along the edges of said slot in the strap;

then driving part of the length of said beam into the ground adjacent to one side of the sheet piling;

then inserting the web of the beam into the slot of the strap with the bars facing the cross arm of the beam;

then welding the facing bar sides to the cross bars of the beam; and securing the other end of the strap to the sheet piling.

2. An installation essentially consisting of a sheet piling, at least one T-beam driven into the ground adjacent to one side of the sheet piling; an elongate strap secured at one end to the sheet piling, the other end of said strap including a lengthwise extending slot, the web of the beam being inserted into said slot, at least one bar fixedly secured to each side of said strap adjacent to said slot and also fixedly secured to and along the cross arm of the beam.

3. The installation according to claim 2 and comprising a pair of bars fixedly secured to one side of the strap and along opposite sides of said slot.

4. The installation according to claim 3 for securing a double T-beam to the sheet piling, further comprising a second pair of bars fixedly secured to the opposite side of said strap and on opposite sides of said slot.

5. The installation according to claim 2, wherein two bars are fixedly secured to each side of the slot parallel thereto and each fixedly secured to the cross bar of the beam.

* * * * *